US007540756B1

(12) United States Patent
Strahl

(10) Patent No.: US 7,540,756 B1
(45) Date of Patent: Jun. 2, 2009

(54) REPLACEMENT DEPRESSIBLE TAB FOR MODULAR TELECOMMUNICATIONS PLUG

(76) Inventor: Michael Strahl, 23 Horseshoe La., Commack, NY (US) 11725

( * ) Notice: Subject to any disclaimer, the term of this patent is extended or adjusted under 35 U.S.C. 154(b) by 0 days.

(21) Appl. No.: 12/011,348

(22) Filed: Jan. 25, 2008

(51) Int. Cl.
*H01R 13/627* (2006.01)

(52) U.S. Cl. ..... 439/354; 439/344

(58) Field of Classification Search ..... 439/344, 439/353, 354, 676, 357
See application file for complete search history.

(56) References Cited

U.S. PATENT DOCUMENTS

| | | | | |
|---|---|---|---|---|
| 4,160,575 | A | 7/1979 | Schraut | |
| 4,607,905 | A | 8/1986 | Vaden | |
| 5,186,649 | A | 2/1993 | Fortner | |
| 5,346,405 | A | 9/1994 | Mosser | |
| 6,116,939 | A | 9/2000 | Fukuda | |
| 6,283,768 | B1 | 9/2001 | Van Naarden | |
| 6,350,157 | B1 | 2/2002 | Mizusawa | |
| 6,398,576 | B1 * | 6/2002 | Hwang et al. | 439/354 |
| 6,612,859 | B2 * | 9/2003 | Yeomans et al. | 439/354 |
| 6,619,989 | B1 * | 9/2003 | Yi | 439/610 |
| 6,796,806 | B2 | 9/2004 | Boutros | |
| 6,846,197 | B2 | 1/2005 | Hirokawa | |
| 6,890,197 | B2 | 5/2005 | Liebenow | |
| 6,918,782 | B2 | 7/2005 | Foster | |
| 6,957,984 | B1 | 10/2005 | Huang | |
| 7,025,636 | B2 | 4/2006 | Allen | |
| 7,361,047 | B2 * | 4/2008 | Strahl | 439/354 |
| 2007/0077806 | A1 * | 4/2007 | Martin et al. | 439/344 |

* cited by examiner

*Primary Examiner*—Hien Vu
(74) *Attorney, Agent, or Firm*—Daniel S. Kirshner

(57) ABSTRACT

A replacement depressible tab for use on a modular connector when the original depressible tab has broken off. The replacement tab of the present invention is incorporated into a clip having a top wall, two side walls, bottom-wall flanges forming a partial bottom wall and an open back. The top wall of the clip is formed in the shape of a "T" having a middle tongue section that extends the entire length of the clip and two wing sections. The tongue is sized and configured to fit into the female modular port. The wings are sized and configured to fit over the telecommunications connector with the broken-off tab.

1 Claim, 6 Drawing Sheets

REPLACEMENT DEPRESSIBLE TAB FOR MODULAR TELECOMMUNICATIONS PLUG

FIELD OF THE INVENTION

The present invention relates to modular connectors of the type utilized in telecommunications equipment, and specifically to a clip that includes a replacement depressible tab to be utilized in conjunction with a modular plug when the original depressible tab has broken off.

SUMMARY OF THE INVENTION

The present invention is a replacement depressible tab for use on a RJ45 Ethernet connector or other such modular connector when the original depressible tab has broken off. The replacement tab of the present invention is incorporated into a clip having a top wall, two side walls, bottom-wall flanges forming a partial bottom wall and an open back. The top wall of the clip is formed in the shape of a "T" having a middle tongue section that extends the entire length of the clip and two wing sections. The tongue is sized and configured to fit into the female modular port. The wings are sized and configured to fit over the telecommunications connector with the broken-off tab. The clip of the present invention is inserted over the damaged modular connector. This spreads the wings apart thereby allowing the clip to fit over and lock onto the damaged modular connector so that the replacement depressible tab is now located in the position of the original, broken-off tab. The modular connector having the replacement depressible tab of the present invention may now be inserted into the modular port in the usual manner thereby securing it therein and enabling the original modular connector to securely complete the electrical connections.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

The present invention is a replacement depressible tab and its housing in the form of a clip for use on a typical prior art modular plug of the type used in connecting telecommunications equipment. As depicted in the embodiment herein, the replacement depressible tab and clip are sized and configured for use in conjunction with a prior art RJ45 modular plug, commonly known as an Ethernet plug. It will be understood, however, that the present invention replacement tab can be sized and configured for use with any other prior art modular plug that includes a depressible tab. Examples of such other prior art modular plugs include RJ11 and RJ14 plugs utilized in connection with telephone equipment and the like.

Figure 1:
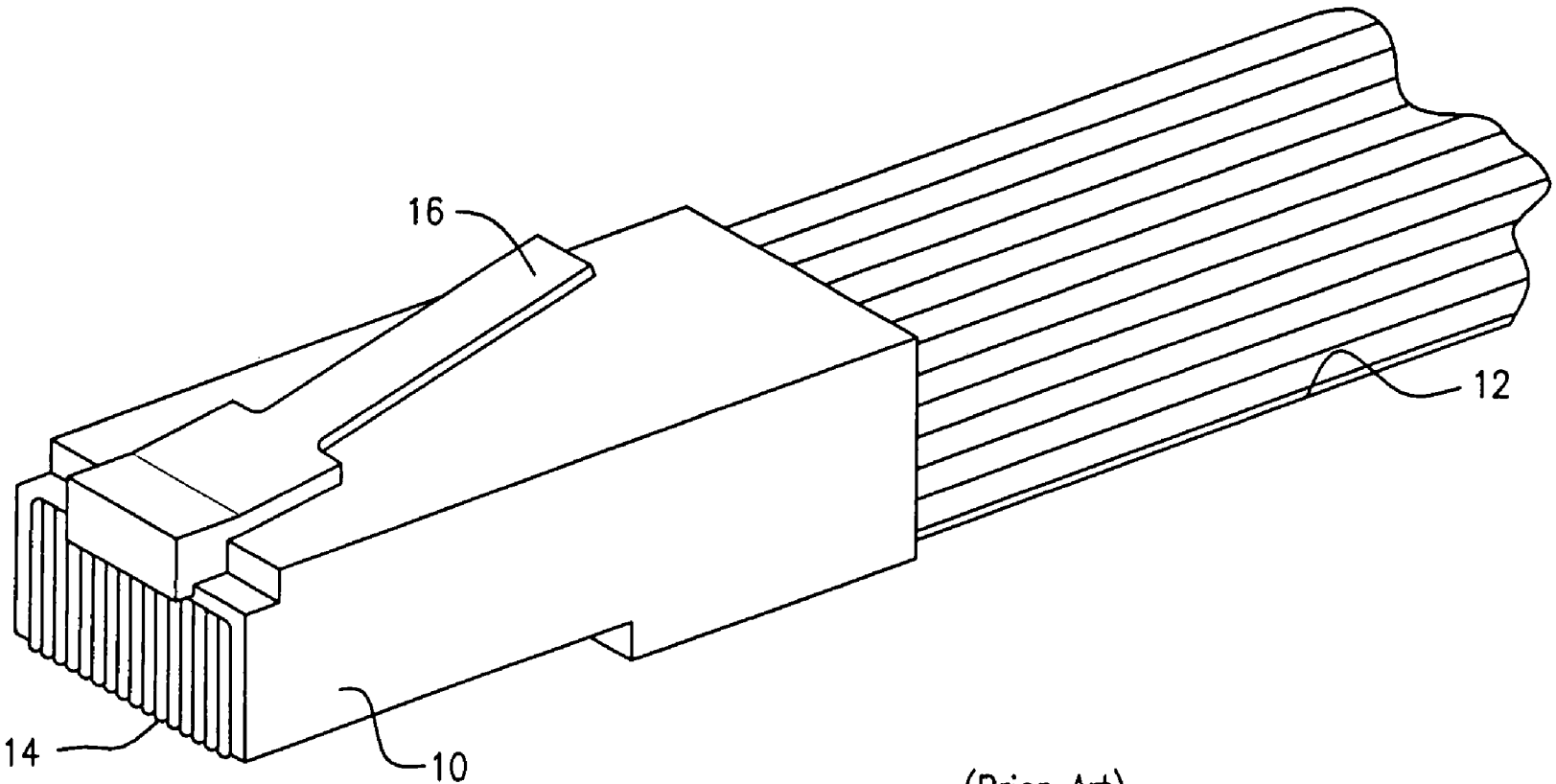
(Prior Art) FIG. 1
FIG. 1 is a perspective view of a typical prior art modular telecommunications plug.

A typical prior art modular plug is depicted in FIG. 1. FIG. 1 shows an RJ45 Ethernet connector 10 attached to the telecommunications cable 12 and provides electrical contacts 14 for transmitting electrical signals. These prior art modular plugs include a depressible plastic tab 16. The depressible tab which is also known as a "plug latching bar" hinges at point 18. As such, the depressible tab is compressed downward when inserted into the corresponding female port of the Ethernet connection, and then flexes back into position within the socket in order to lock the modular plug in place in the port. A user can subsequently depress the tab 16 to permit the modular plug to be removed from the port.

Figure 2:
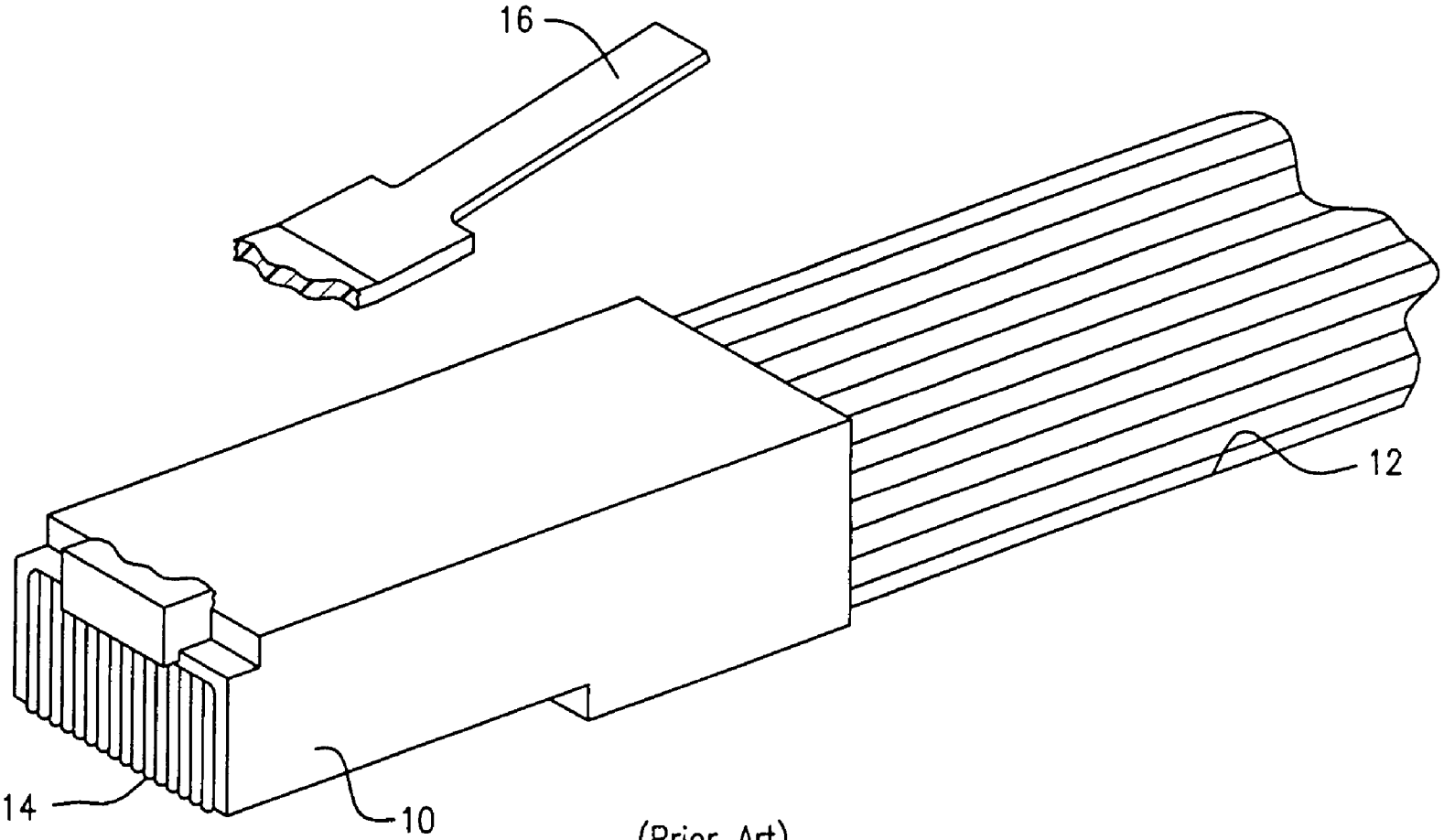
(Prior Art) FIG. 2
FIG. 2 is a perspective view of a typical prior art modular telecommunications plug with its depressible tab broken off.

It is common for the prior art depressible tab 16 to break off from the body of the modular plug as depicted in FIG. 2. Once this occurs, the modular plug can no longer be secured into position in the port thereby compromising the integrity of the electrical connections.

Figure 3:
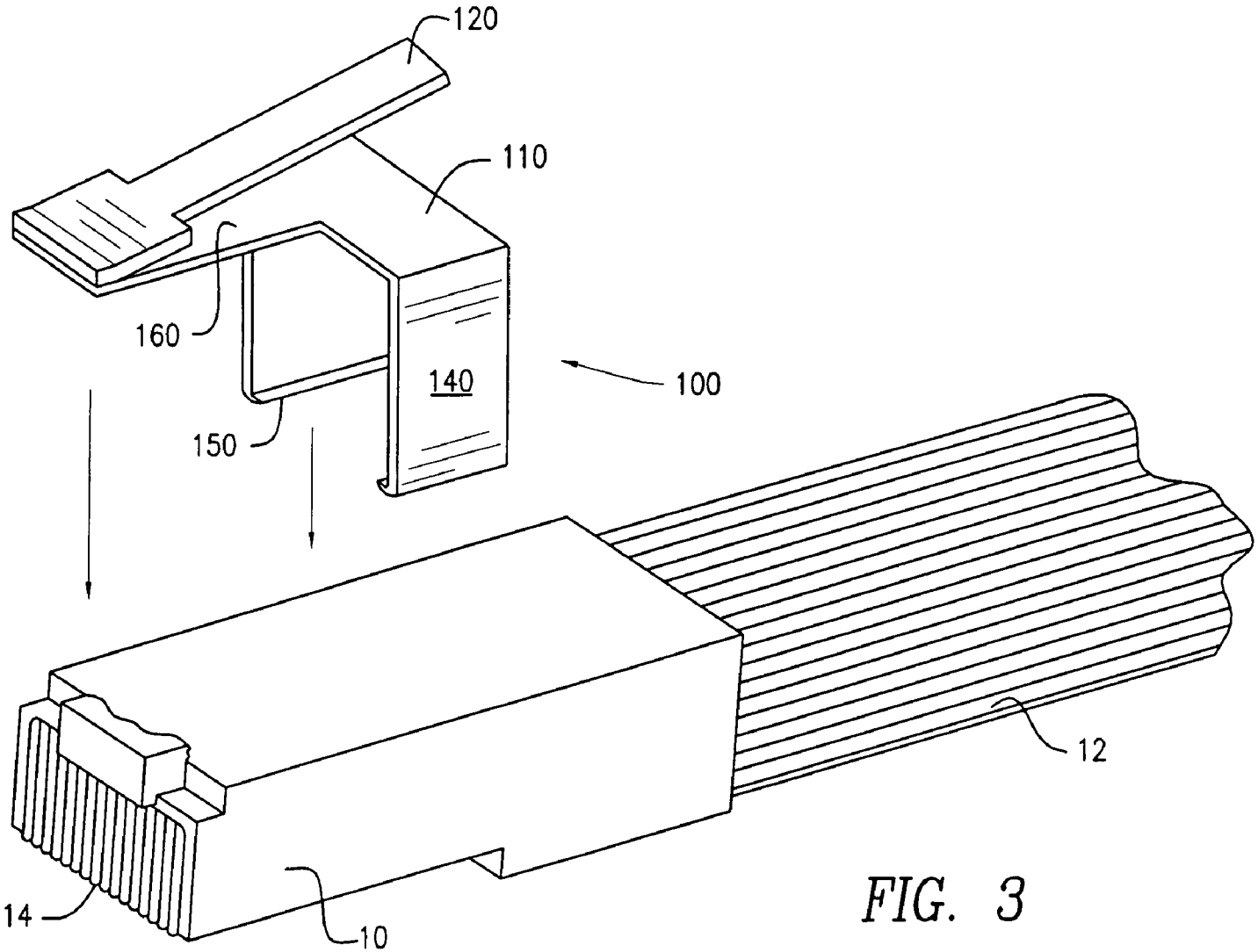
FIG. 3 is a right side perspective view of the present invention replacement tab and clip for use with a modular plug.

The present invention replacement tab 100 is depicted in the perspective view of FIG. 3. The replacement tab 100 is utilized to replace the broken-off tab of the prior art modular plug so that the integrity of the electrical connections can be secured.

Generally, the replacement tab 100 of the present invention comprises a clip section 110 and a replacement tab 120. The clip and the replacement tab are both formed from lightweight plastic and are properly sized and configured for insertion over the prior art modular plug.

The clip includes a top wall 130, two side walls 140 extending perpendicularly downward from the top wall, and two small projections 150 projecting perpendicularly inward from the two side walls along the bottom of the housing. The clip has an open back.

Looking more closely at the walls of the clip, the top wall 130 is formed generally in the shape of a 'T' comprising a middle tongue section and two wing sections that extend out perpendicularly from the tongue section. The width of the clip at the wings sections is slightly larger than the width of the modular plug with the broken-off tab so that when installed the clip fits snugly over the modular plug. The middle tongue section of the top wall 130 extends the full length of the clip and is sized and configured to fit into the female port of the RJ45 or other modular plug. It will be understood that the configuration, width and thickness of the tongue are chosen so that the tongue and depressible tab may readily be inserted into the appropriate modular port. The depressible tab 120 is aligned generally parallel to the middle tongue section of the top wall and is flexibly attached to the front end of the middle tongue section of the top wall and extends angularly upward therefrom.

The two side walls extend downward perpendicularly from the wing sections of the t-shaped top wall. As such, although the clip fits in place over the original modular plug, only the tongue and depressible tab are inserted into the modular port.

Extending inward from the side walls and into the interior portion of the housing are the projections or flanges 150 which form a partial bottom wall. The projections extend only partially into the interior of the housing in order to allow the housing to be easily installed over a telecommunications cable.

The depressible tab 120 is flexibly attached to the tongue 160 near the front of the housing, and extends angularly upward toward the back of the housing. The tab is compressible so that it flexes downward when the replacement tab is inserted into a modular port. Thereafter, upon insertion into the modular port, the depressible tab flexes back upward into its original configuration.

Figure 4:
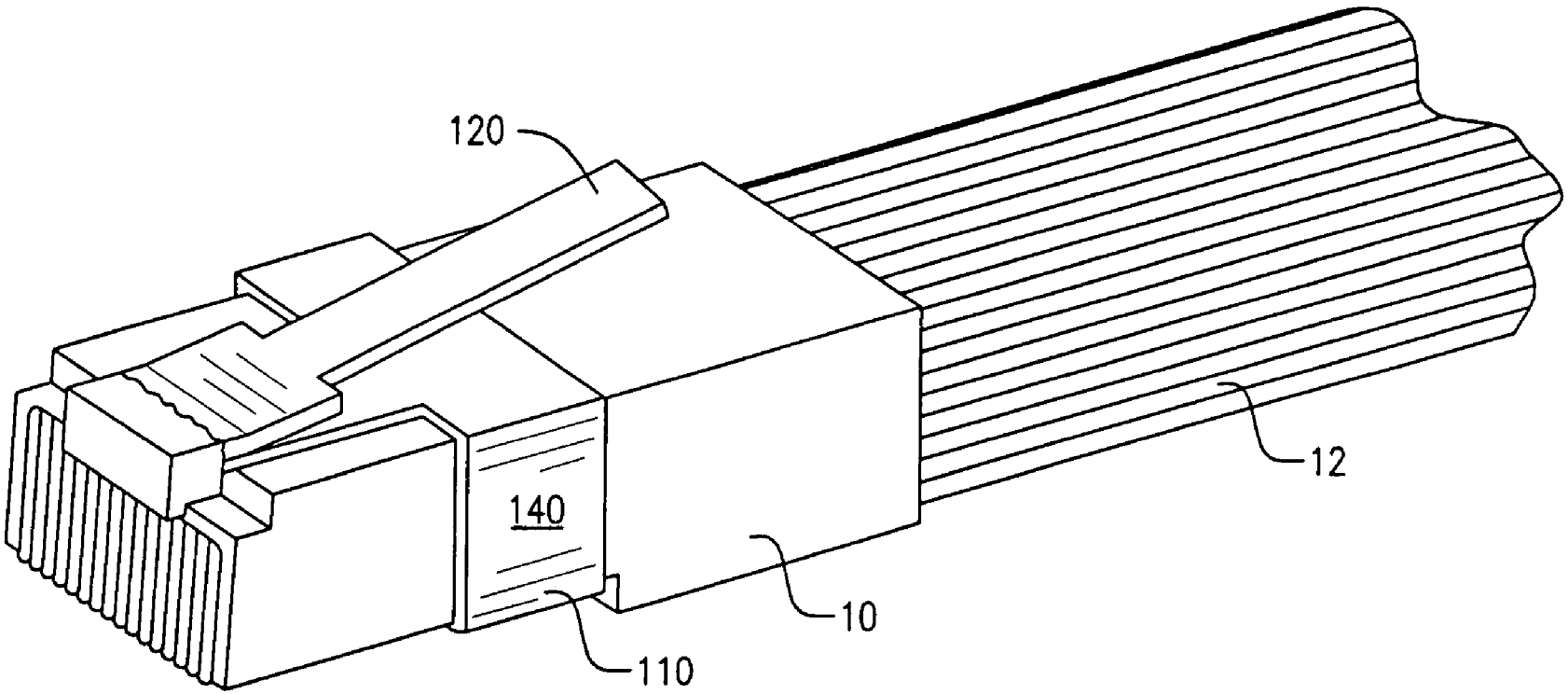
FIG. 4 is a right side perspective view of the present invention replacement tab showing it installed on a modular telecommunications plug.
Figure 5:
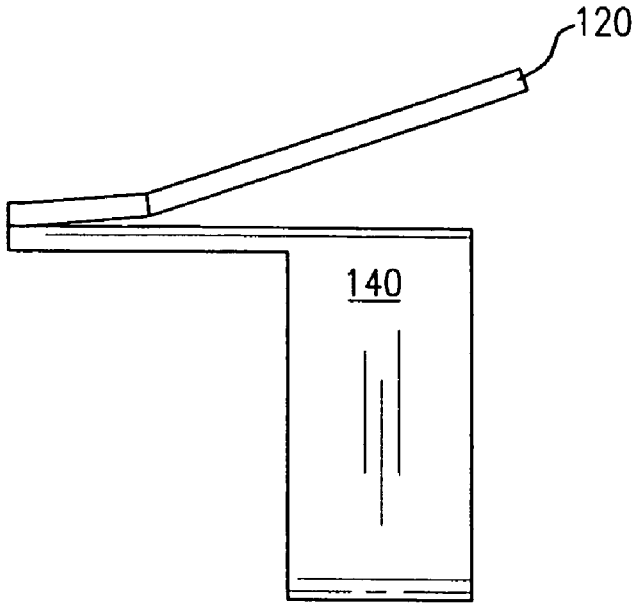
FIG. 5 is a right side elevational view of the present invention replacement tab and clip.
Figure 6:
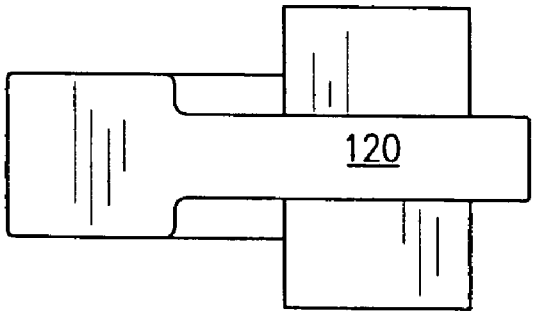
FIG. 6 is a top view of the present invention replacement tab and clip.
Figure 7:
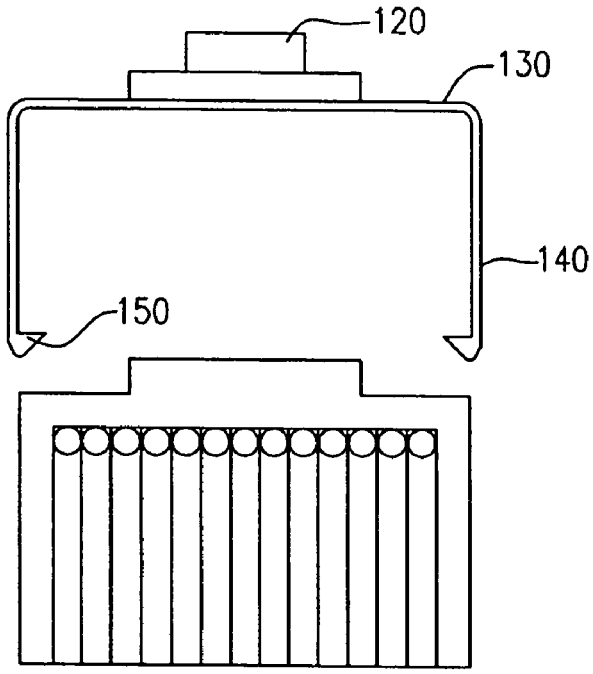
FIG. 7 is a front view of the present invention replacement tab and clip as it is about to be installed onto a prior art modular plug.
Figure 8:
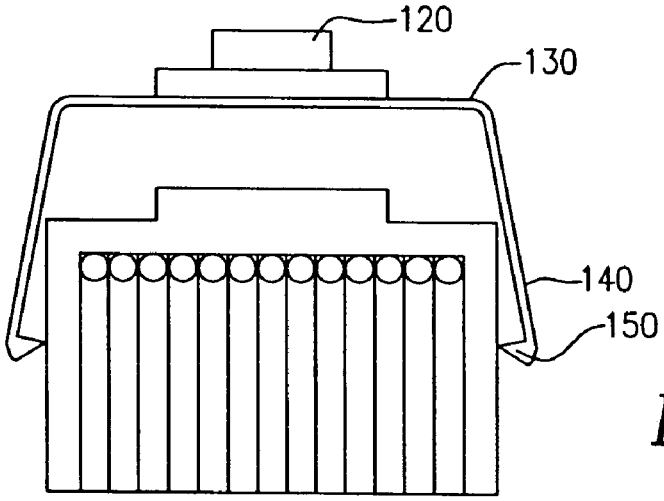
FIG. 8 is front view of the present invention replacement tab and housing shown partially installed onto a prior art modular plug.
Figure 9:
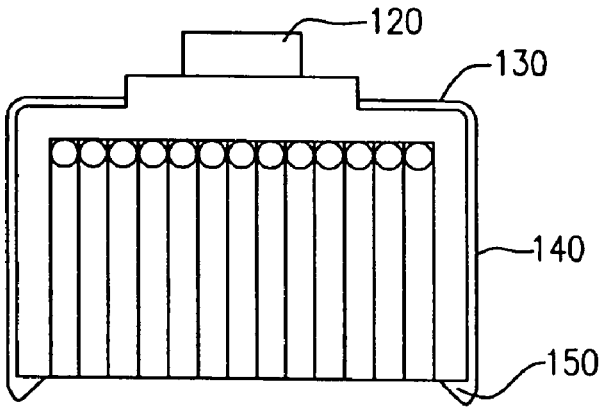
FIG. 9 is front view of the present invention replacement tab and housing shown fully installed onto a prior art modular plug.

The present invention is utilized in conjunction with an Ethernet plug or other such modular connector when its original depressible tab is broken off. As seen best in FIGS. 7, 8 and 9, the replacement tab of the present invention is utilized in the following manner. Presented with a modular connector whose depressible tab has broken off, the user inserts the modular telecommunications plug through the partially open bottom of the housing. As seen in FIG. 8, the clip is pushed downward over the modular plug having a broken-off depressible tab, thereby spreading apart the side walls of the clip angularly. When the replacement depressible tab of the present invention is pushed down further over the modular plug, the side walls snap back to their original configuration, and the clip is locked fully in place over the modular plug, as best depicted in FIG. 9. The locking of the clip in place over the modular plug is due to three factors. First, the clip cannot move forward over the damaged end of the modular plug due to the nub that is left behind after the tab break off (see FIGS. 2 and 4.) Second, the clip cannot move backwards due to the abutment of the bottom wall flanges 150 against the single step on the bottom of a damaged or non-damaged modular plug as seen in FIG. 4. Third, the clip cannot move up or down due to the bottom wall flanges of the sidewalls of the clip snapping under the bottom of the damaged modular plug after pulling down the sides as seen in FIG. 9. Once the clip with replacement tab is snapped into place over the damaged modular plug, the modular plug can be inserted into the telecommunications port in the usual manner.

As will be appreciated, utilization of the present invention replacement tab is a time-saving device. With prior art Ethernet connectors or other such modular plugs, once the depressible tab has broken off, the user needs to cut off the connector, strip the wire, and replace the original modular connector. Through use of the present invention, these steps are eliminated.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A replacement tab for use on a modular telecommunications connector having a broken-off depressible tab comprising:

a clip, said clip sized and configured to fit over the modular telecommunications connector having a broken-off depressible tab, said clip having a top surface with a front edge and a back edge, the top surface including a tongue section and two wing sections that extend downward in a predetermined configuration from a rear portion of said top surface, each of the wing sections having an inward flange on an edge thereof for engaging with a bottom groove section of the modular telecommunications connector;

a replacement depressible tab flexibly attached at said front edge of said top surface of said clip and extending angularly upward toward said back edge of said clip;

whereby the clip is installed onto the modular telecommunications connector by pushing said clip down over the modular telecommunications connector thereby spreading apart said wings during installation from said predetermined configuration and whereby said wings return to their said predetermined configuration to engage with the bottom groove section upon installation.

* * * * *